US007730642B2

(12) United States Patent
Sugiura

(10) Patent No.: US 7,730,642 B2
(45) Date of Patent: Jun. 8, 2010

(54) SNOW BLOWER

(75) Inventor: Keisuke Sugiura, Shizuoka (JP)

(73) Assignee: Yamaha Motor Power Products Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/345,762

(22) Filed: Dec. 30, 2008

(65) Prior Publication Data

US 2009/0183395 A1 Jul. 23, 2009

(30) Foreign Application Priority Data

Jan. 17, 2008 (JP) ..... 2008-007571

(51) Int. Cl.
*E01H 5/09* (2006.01)

(52) U.S. Cl. ..... 37/257; 37/244; 37/238; 37/248; 180/53.1

(58) Field of Classification Search ..... 37/237–262; 180/53.1; 74/664; 56/2, 16.9
See application file for complete search history.

(56) References Cited

U.S. PATENT DOCUMENTS 1,577,561 A * 3/1926 Chiles ..... 37/248
2,536,166 A * 1/1951 Garland ..... 37/245
2,545,795 A * 3/1951 Roos ..... 254/328
2,700,863 A * 2/1955 Etem ..... 56/11.5
2,754,602 A * 7/1956 Gans ..... 37/241
2,770,894 A * 11/1956 Gettelman ..... 37/260
2,815,590 A * 12/1957 Fiacco ..... 37/248
3,115,714 A * 12/1963 Johann ..... 37/250
3,226,853 A * 1/1966 Kamlukin ..... 37/244
3,483,938 A * 12/1969 Enters ..... 180/53.7
3,580,351 A * 5/1971 Mollen ..... 180/53.7
3,673,715 A * 7/1972 Lines ..... 37/251
3,673,776 A * 7/1972 Smith ..... 56/16.9
3,774,322 A * 11/1973 Enters et al. ..... 37/251
3,783,592 A * 1/1974 Schraut ..... 56/13.3
4,255,879 A * 3/1981 Greider ..... 37/245
4,457,086 A * 7/1984 Bacon ..... 37/257
4,549,365 A * 10/1985 Johnson ..... 37/251
4,640,378 A * 2/1987 Dobberpuhl et al. ..... 180/53.1
4,683,766 A * 8/1987 Hatakeyama et al. ..... 74/333
4,763,744 A * 8/1988 McVicar et al. ..... 180/53.7
4,783,915 A * 11/1988 Sasaki et al. ..... 37/251

(Continued)

FOREIGN PATENT DOCUMENTS

JP 2896700 B2 5/1999

*Primary Examiner*—Thomas A Beach
(74) *Attorney, Agent, or Firm*—Keating & Bennett, LLP

(57) ABSTRACT

An engine of a snow blower is arranged with a crankshaft along a front to rear direction of the snow blower, and an output shaft, with an outer circumferential portion on which a drive pulley is fixed, is provided in a front end portion of the crankshaft. Further, an intermediate shaft with a rear end circumference on which a driven pulley is fixed and with a front end circumference, on which an impeller drive pulley is fixed, is arranged to extend toward a front direction higher than the output shaft. An impeller drive shaft with a rear end circumference on which an impeller driven pulley is fixed is arranged to extend toward the front direction more downward than the intermediate shaft. A first transmission belt is meshed with the drive pulley and the driven pulley, and a second transmission belt is meshed with the impeller drive pulley and the impeller driven pulley. Using this arrangement, it is possible to provide a snow blower with a low center of gravity.

8 Claims, 12 Drawing Sheets

U.S. PATENT DOCUMENTS 4,825,970 A * 5/1989 McVicar et al. ..... 180/53.7
4,897,942 A * 2/1990 Klas et al. ..... 37/244
5,090,142 A * 2/1992 Peters ..... 37/243
6,131,316 A * 10/2000 Yoshina et al. ..... 37/242
6,643,959 B2 * 11/2003 Jolliff et al. ..... 37/244
6,688,022 B2 * 2/2004 Hanafusa et al. ..... 37/257
6,742,290 B2 * 6/2004 Hanafusa ..... 37/248
6,941,735 B1 * 9/2005 Tamas ..... 56/2
2001/0032447 A1 * 10/2001 Jolliff et al. ..... 56/16.7

* cited by examiner

SNOW BLOWER

BACKGROUND OF THE INVENTION

1. Field of the Invention

The present invention relates to a snow blower provided with a rotational force transmission mechanism arranged to transmit a rotational force of a crankshaft to an impeller drive shaft.

2. Description of the Related Art

Conventionally, there is a snow blower having an engine that rotates an auger in a spiral fashion thereby removing snow from a snow covered surface (see JP-B-2896700, for example). An impeller auger drive system is arranged in a lower direction on a front portion of an output shaft of the engine in the snow blower. A front upper pulley and a front lower pulley are provided in a front portion of the output shaft and in a rear portion of the impeller drive shaft, respectively, and a front side belt is meshed with the front upper pulley and the front lower pulley. As a result, when the engine operates, a drive force thereof is transmitted to the auger drive system via the output shaft, the front side belt, and the impeller drive shaft.

However, according to the snow blower described above, an engine having a large weight is arranged on an upper portion of the snow blower, and the drive force of the engine is transmitted from the output shaft to the impeller drive shaft located in a lower portion of the snow blower. Therefore, the snow blower has a high center of gravity.

SUMMARY OF THE INVENTION

In order to overcome the problems described above, preferred embodiments of the present invention provide a snow blower having a low center of gravity.

A snow blower according to a preferred embodiment of the present invention includes an engine arranged with a crankshaft along a front to rear direction of the snow blower; an output shaft provided on a front end portion of the crankshaft, coaxially with the crankshaft, and having an outer circumferential portion on which a drive pulley is fixed; an intermediate shaft arranged to extend in the front to rear direction above the output shaft and having a rear end outer circumferential portion on which a driven pulley is fixed and a front end outer circumferential portion on which an impeller drive pulley is fixed; an impeller drive shaft arranged to extend in the front to rear direction below the intermediate shaft and having a rear end outer circumferential portion on which an impeller driven pulley is fixed; a first transmission belt meshed with the drive pulley and the driven pulley; and a second transmission belt meshed with the impeller drive pulley and the impeller driven pulley.

According to a preferred embodiment of the snow blower, a drive force of the engine transmitted to the output shaft via the crankshaft is preferably not directly transmitted to the impeller drive shaft via a predefined transmission belt, but is intermediately transmitted from the output shaft to the intermediate shaft located above the output shaft and the impeller drive shaft before being transmitted from the intermediate shaft to the impeller drive shaft. This means that transmission of the rotational force from the output shaft to the intermediate shaft is performed by meshing the first transmission belt between the drive pulley provided on the output shaft and the driven pulley provided in a rear portion of the intermediate shaft. Moreover, transmission of the rotational force from the intermediate shaft to the impeller drive shaft is performed by meshing the second transmission belt between the impeller drive pulley provided on a front portion of the intermediate shaft and the impeller driven pulley provided on a rear portion of the impeller drive shaft.

According to a preferred embodiment of the snow blower, a rotational force of the output shaft is preferably transmitted to the impeller drive shaft via the intermediate shaft arranged in the position above the output shaft and the impeller drive shaft. Therefore, the output shaft and the impeller drive shaft can have substantially the same height. Consequently, an engine having a relatively large weight and volume can be arranged in a lower portion of the snow blower. As a result, it is possible to provide the snow blower with a low center of gravity. Furthermore, because the engine is arranged in the lower portion of the snow blower, a space in an upper portion of the snow blower is not occupied by the engine. Therefore, other devices can be arranged in the upper portion of the snow blower. Moreover, since the whole snow blower can be lowered, the portion of the snow blower that is covered with a cover can be reduced.

Further, in the structure of the snow blower according to a preferred embodiment of the present invention, the intermediate shaft and the impeller drive shaft are preferably arranged such that a virtual straight line connecting shaft axes of the intermediate shaft and the impeller drive shaft inclines toward one side of the width direction of the snow blower in a view seen from the front of the snow blower. A belt clutch mechanism enabling or interrupting transmission of the rotational force of the intermediate shaft to the impeller drive shaft by changing the tensile stress of the second transmission belt is preferably arranged on one of the outer circumferential sides between the impeller drive pulley and the impeller driven pulley on the second transmission belt.

As a result, the belt clutch mechanism is arranged above or below the inclining second transmission belt such that a toroidal shape of the second transmission belt is arranged in the front to rear direction and in which the longitudinal direction is arranged generally in the vertical direction. Accordingly, the second transmission belt and the belt clutch mechanism can be compactly arranged in the width direction of the snow blower. Furthermore, since the second transmission belt is inclined to be meshed with the impeller drive pulley of the intermediate shaft and the impeller driven pulley of the impeller drive shaft, the height of the upper portion of the snow blower can be lowered due to the inclination of the second transmission belt. In this case, it is preferable that the first transmission belt is also meshed between the drive pulley of the output shaft and the driven pulley of the intermediate shaft such that the first transmission belt is inclined in the same direction in parallel or substantially parallel with the second transmission belt.

Furthermore, in the structure of the snow blower according to a preferred embodiment of the present invention, one of the outer circumferential sides of the second transmission belt on which the belt clutch mechanism is arranged is an upper side of the inclined virtual straight line connecting the shaft axes of the intermediate shaft and the impeller drive shaft. Normally, there are a small number of other members arranged on an upper side in the longitudinal direction of the outer circumference of the inclined second transmission belt. Therefore, the belt clutch mechanism can be arranged without concern about any interference with another member.

Furthermore, in the structure of the snow blower according to a preferred embodiment of the present invention, the output shaft and the impeller drive shaft are arranged such that shaft axes of the output shaft and the impeller drive shaft are coaxial or in a vicinity of each other in a view seen from the front direction of the snow blower. As a result, the output shaft and the impeller drive shaft can be arranged generally in a linear arrangement, and the belt clutch mechanism and so forth can be arranged there around. Therefore, the impeller mounted on the engine and/or the impeller drive shaft can be compactly arranged in the width direction or in the height direction of the snow blower.

Furthermore, in the structure of the snow blower according to a preferred embodiment of the present invention, the output shaft and the impeller drive shaft are arranged such that the shaft axes of the output shaft and the impeller drive shaft are coaxial or in a vicinity of each other in a view seen from the front of the snow blower, and that a belt tensioner increasing the tensile stress of the first transmission belt is arranged on a side opposite to the side of the outer circumferential portion of the first transmission belt on which the belt clutch mechanism is arranged. As a result, the belt tensioner and the belt clutch mechanism can be compactly arranged in all directions such as the front to rear direction, the width direction, and the vertical direction of the snow blower such that no interference occurs therebetween.

Furthermore, in this case, it is preferable that the belt tensioner is arranged on an outer circumference of a portion where tensile stress between shafts generated when the first transmission belt is rotating is small, and that the belt clutch mechanism is arranged on an outer circumference of a portion where tensile stress between shafts generated when the second transmission belt is rotating is small. As a result, the first transmission belt and the second transmission belt can be appropriately tensioned to ensure transmission of drive force. Sides on which the tensile stress between the shafts of the first transmission belt and the second transmission belt is small are in positions opposed to each other in the width direction when viewed from the front of the snow blower. For example, when viewed from the front of the snow blower, if the output shaft rotates counterclockwise, the tensile stress between the shafts of the right side portion of the first transmission belt becomes smaller than the tensile stress between the shafts of the left side portion thereof, and, on the other hand, the tensile stress between the shafts of the right side portion of the second transmission belt becomes larger than the tensile stress between the shafts of the left side portion thereof.

As a result, when the belt tensioner and the belt clutch mechanism are located at a side, respectively, on which the tensile stress between the shafts of the first transmission belt and the second transmission belt is small, the belt tensioner and the belt clutch mechanism are located in positions opposed to each other in the width direction when viewed from the front of the snow blower. As a result, the belt tensioner and the belt clutch mechanism do not interfere with each other. Accordingly, the belt tensioner and the belt clutch mechanism can be compactly arranged in all directions, such as the front to rear direction, the width direction, and the vertical direction of the snow blower.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
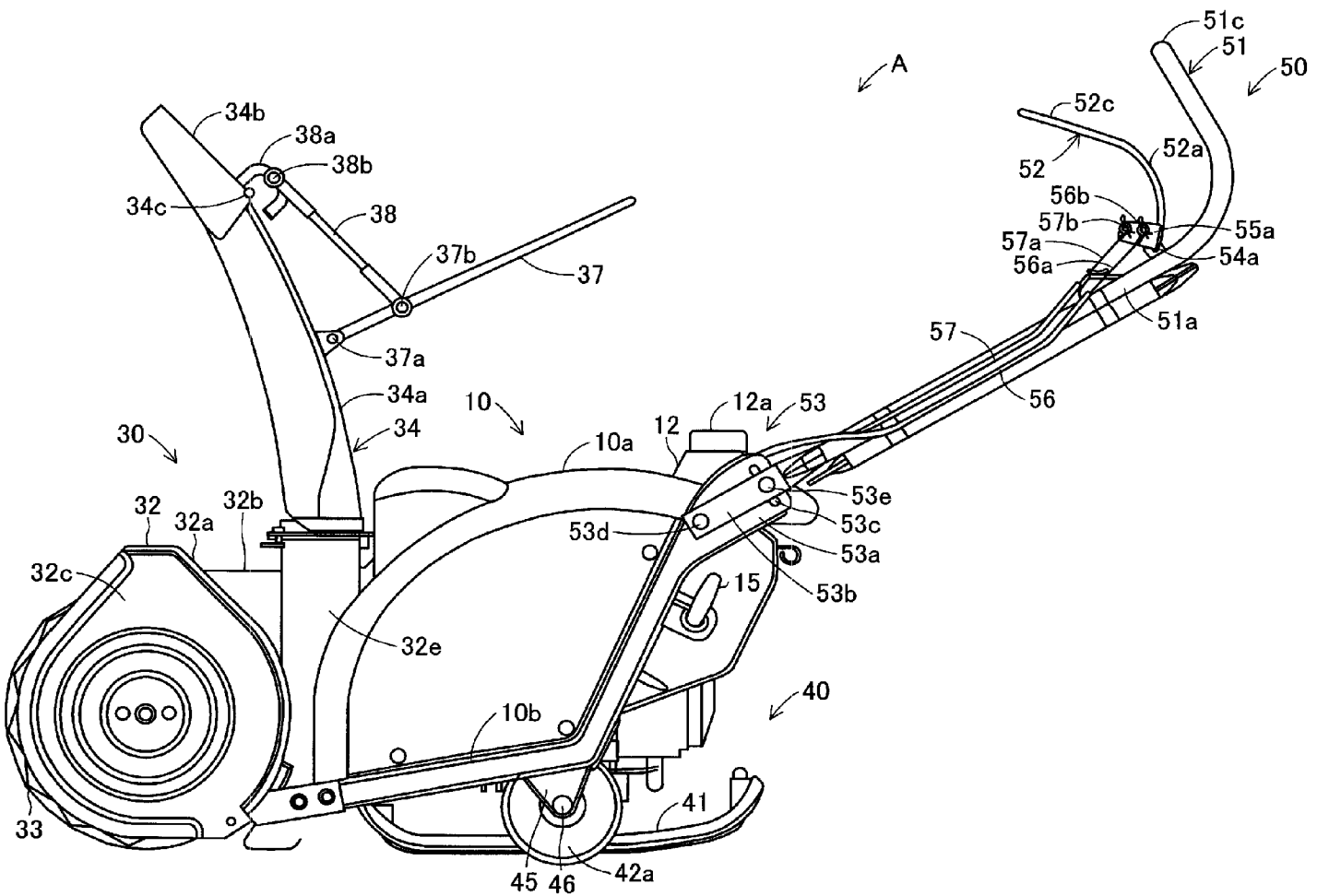
FIG. 1 is a side view showing a snow blower according to a preferred embodiment of the present invention.
Figure 2:
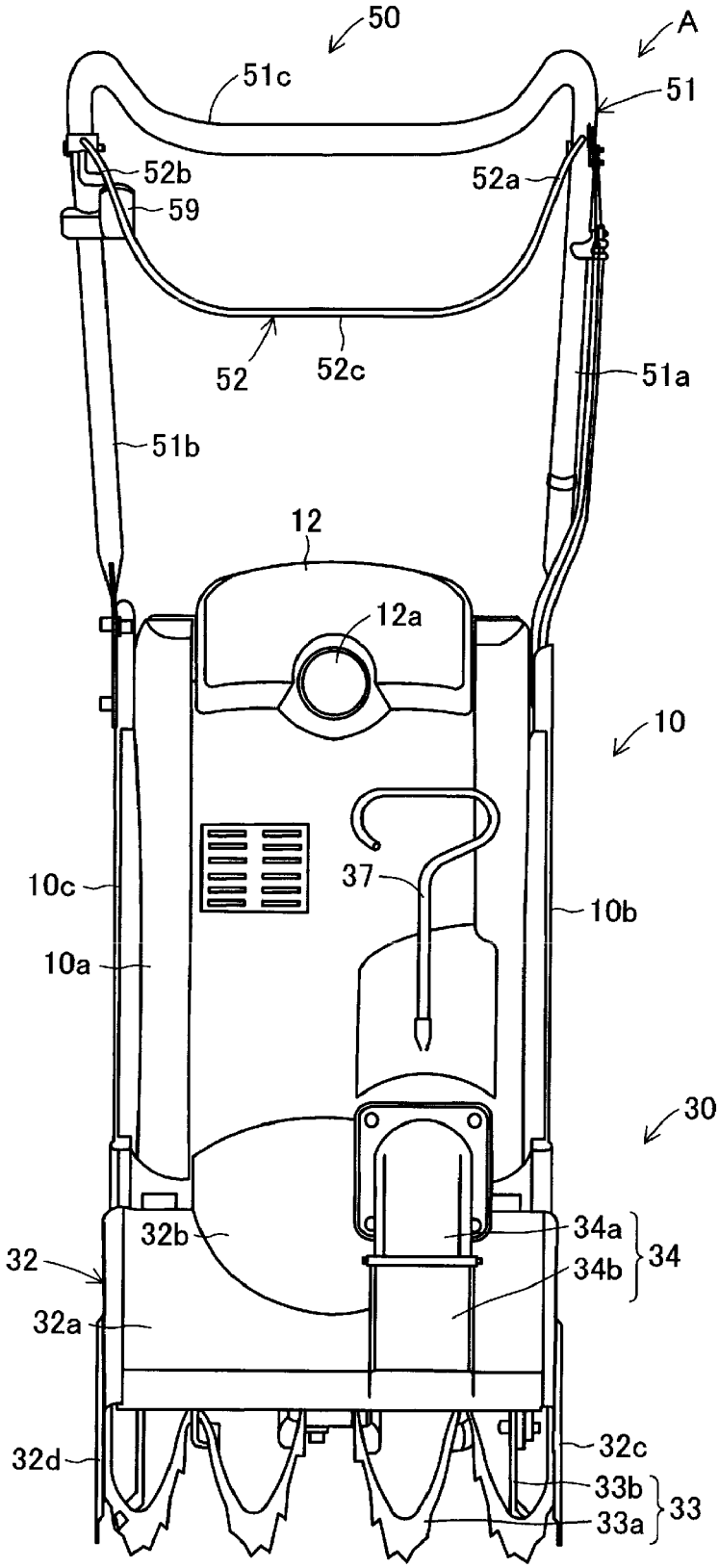
FIG. 2 is a plan view showing the snow blower according to a preferred embodiment of the present invention.

A snow blower according to preferred embodiments of the present invention will be described hereinafter with reference to the accompanying drawings. FIGS. 1 to 4 show a snow blower A according to a preferred embodiment of the present invention. The snow blower A includes a snow blower main body 10, a snow blowing portion 30 provided in a front portion of the snow blower main body 10, a supporting portion 40 supporting the snow blower main body 10, and an operating portion 50 provided in a rear portion of the snow blower main body 10. The snow blower main body 10 has an exterior casing portion 10*a* having a box-like shape defining a generally rectangular shape in a plan view, and having a side surface with a fan shape and a pair of bending supporting frames 10*b* and 10*c* supporting a portion extending from a lower edge portion to a rear edge portion on both side surfaces of the exterior casing portion 10*a*.

An engine 11 is arranged in a center lower portion inside the exterior casing portion 10*a* as shown in FIG. 5 to FIG. 8, and a fuel tank 12 is arranged in a rear upper portion of the exterior casing portion 10*a*. A fuel supply opening is provided at the upper center surface of the fuel tank 12, and a tank cap 12*a* is detachably attached to the fuel supply opening. Further, a vent hole (not shown) for taking in ambient air is provided in a rear end portion of the exterior casing portion 10*a*.

Figure 6:
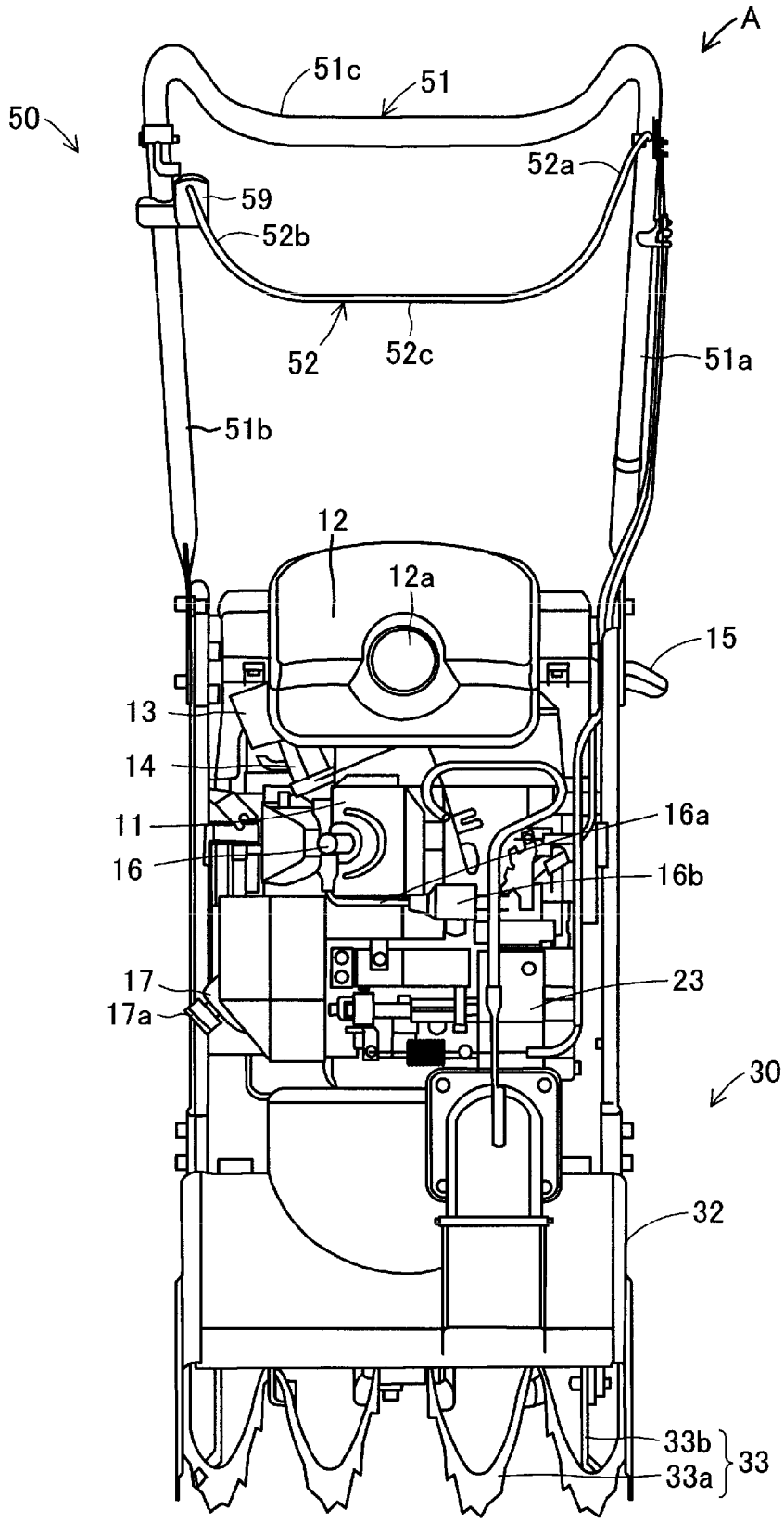
FIG. 6 is a plan view showing the snow blower according to a preferred embodiment of the present invention in a state in which the exterior casing portion has been removed.
Figure 7:
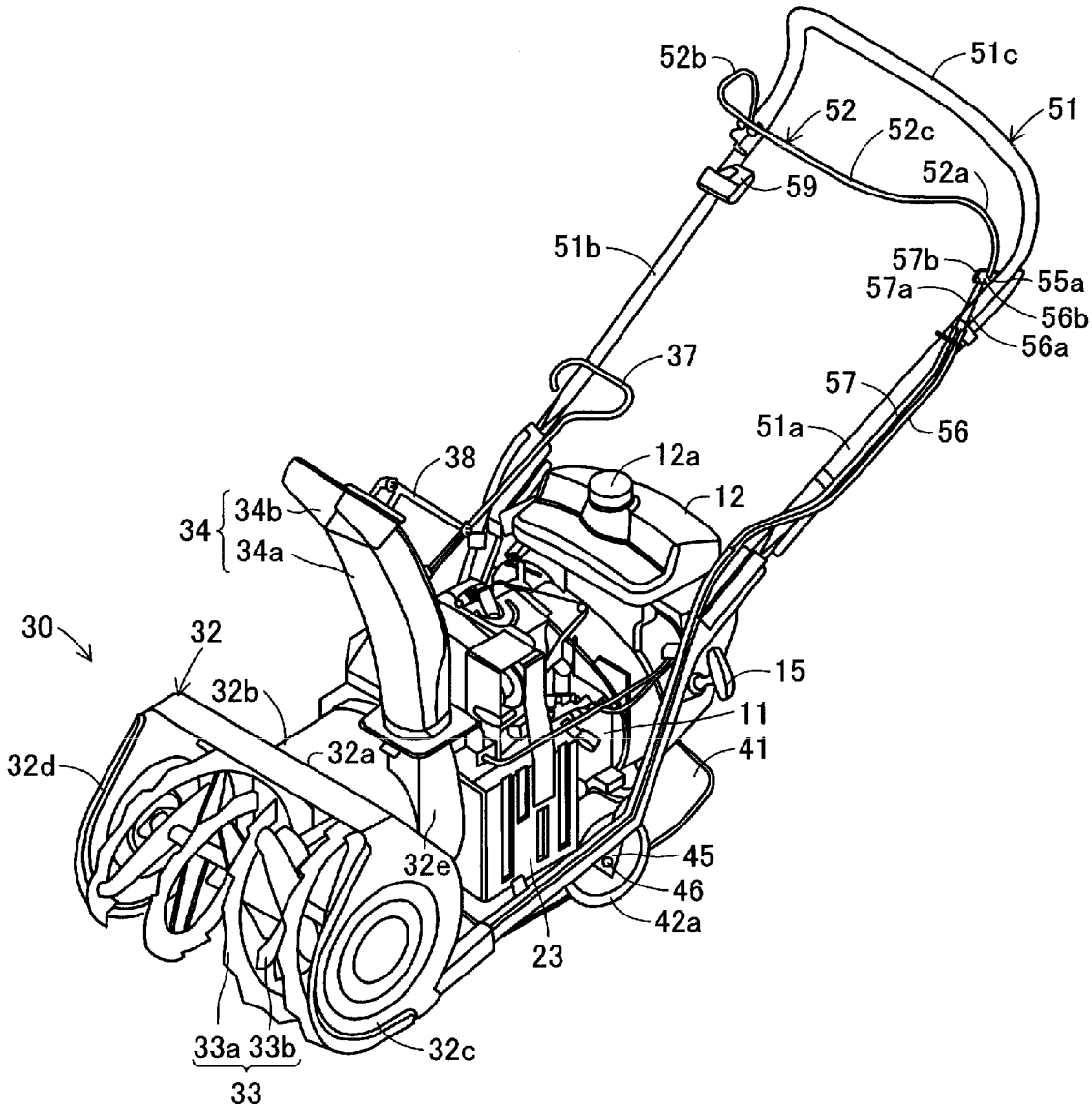
FIG. 7 is a perspective view showing the snow blower according to a preferred embodiment of the present invention in a state in which the exterior casing portion has been removed.

An air cleaner 13 is preferably provided in an upper portion of a rear left side portion of the exterior casing portion 10*a*, as shown in FIG. 6 (in the description below, the left and right directions will be the left and right directions as seen from the front side of the snow blower A), and a carburetor 14 is provided adjacent to the air cleaner 13 on a front portion of the air cleaner 13. The air cleaner 13 is located on an intake side of the engine 11 and takes in ambient air via the vent hole so as to remove foreign matter before sending the ambient air to the carburetor 14. An end portion of a fuel pipe (not shown) extending from the fuel tank 12 is connected to the carburetor 14.

Fuel is supplied to the carburetor 14 from the fuel tank 12 via the fuel pipe. The fuel supplied to the carburetor 14 is mixed with air sent from the air cleaner 13 to the carburetor 14 and supplied to the engine 11 as a gaseous mixture. Further, a recoil handle 15 projects outward from a rear portion on a right side surface of the exterior casing portion 10*a*. The recoil handle 15 is connected to a recoil starter (not shown) provided adjacent to the engine 11 via a recoil rope. The recoil starter is connected to a crankshaft 11*a* (see FIG. 9) of the engine 11, and the crankshaft 11*a* is rotated to start the engine 11 when the recoil handle 15 is pulled.

A spark plug 16 is provided in the engine 11, and a muffler 17 is provided on an exhaust side portion of the engine 11. The spark plug 16 is connected to an ignition system 16*b* via an ignition cord 16*a*. The spark plug 16 ignites the gaseous mixture supplied from the carburetor 14 by an operation of the ignition system 16*b* and enables the gaseous mixture to explode in the engine 11 to rotate and operate the engine 11. Exhaust gas exhausted from the engine 11 is sent to the muffler 17, silenced by the muffler 17, and emitted from an exhaust pipe 17*a* to the outside. Further, a speed governor 18 is connected to the carburetor 14 to adjust the rotational speed of the engine 11 by adjusting the amount of fuel supplied from the fuel tank 12 via the fuel pipe.

The speed governor 18 preferably includes an accelerator lever 18*c* rotating in the clockwise direction with a center shaft 18*b* at the center, as seen in the plan views shown in FIG. 6 and FIG. 9, as a result of the fact that a rear end connecting portion 18*a* is pulled to the right side by an operation of an operating lever 52 described below; and a return spring 18*d* biasing the accelerator lever 18*c* provided at a front end side of the accelerator lever 18*c* in the counterclockwise direction. The speed governor 18 also includes a governor arm portion 19 connecting a portion at a predetermined constant distance from the rear end connecting portion 18*a* on a rear left side of the accelerator lever 18*c* and the carburetor 14.

The governor arm portion 19 preferably has a pair of governor arms 19*a* and 19*b* capable of bending at a connecting portion at the center of the governor arms 19*a* and 19*b*. A front end portion of the governor arm 19*a* is movably connected to a rear left portion of the accelerator lever 18*c* via a spring 19*c*, and a center portion of the governor arm 19*a* is rotatably supported by an axial portion 19*d*. Further, a right end portion of the governor arm 19*b* is rotatably connected to a rear end portion of the governor arm 19*a*, and a left end portion thereof is connected to the carburetor 14.

As a result, when the accelerator lever 18*c* rotates, the governor arm 19*a* rotates with the axial portion 19*d* at the center of the governor arm 19*a*. Then, as a result of the rotation, the end portion of governor arm 19*b* moves closer to or farther away from the carburetor 14. The end portion of governor arm 19*b* rotates a lever connected to the carburetor 14 and adjusts an opening angle of a throttle valve of the carburetor 14. As a result of the movement of the governor arm 19*b* and the rotation of the lever of the carburetor 14, the amount of fuel supplied to the carburetor 14 from the fuel tank 12 via the fuel pipe is changed, and the rotational speed of the engine 11 is changed accordingly. The amount of movement of the governor arm 19*b* in this case is located such that the rotational speed of the engine 11 is set to a predefined speed.

Figure 9:
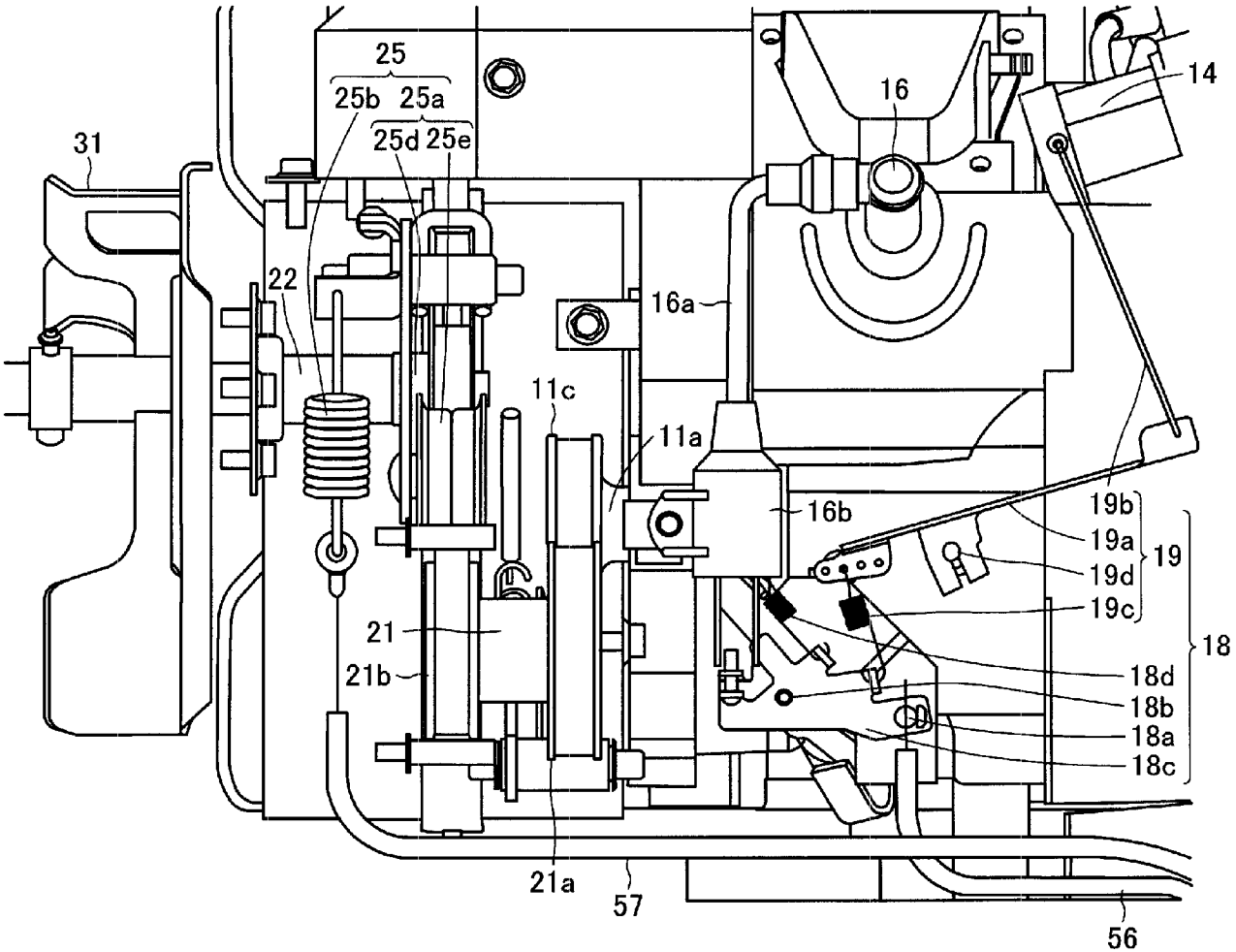
FIG. 9 is a plan view showing a major portion in the main body of the snow blower according to a preferred embodiment of the present invention.

In other words, the axial portion 19*d* is linked to the rotational speed of the crankshaft 11*a* of the engine 11 and is arranged such that the axial portion 19*d* receives a force causing a clockwise rotation in a state shown in FIG. 9 as the rotational speed of the crankshaft 11*a* increases. As a result, the rotational force of the accelerator lever 18*c* transmitted via the governor arm 19*a* and the rotational force transmitted in response to the rotational speed of the crankshaft 11*a* are applied to the axial portion 19*d*. As a result, a rotational angle of the governor arm 19*a* is controlled and located in a predefined position in which the rotational force transmitted from the accelerator lever 18*c* and the rotational force received from the axial portion 19*d* are balanced in response to the rotational speed of the crankshaft 11*a*.

Figure 8:
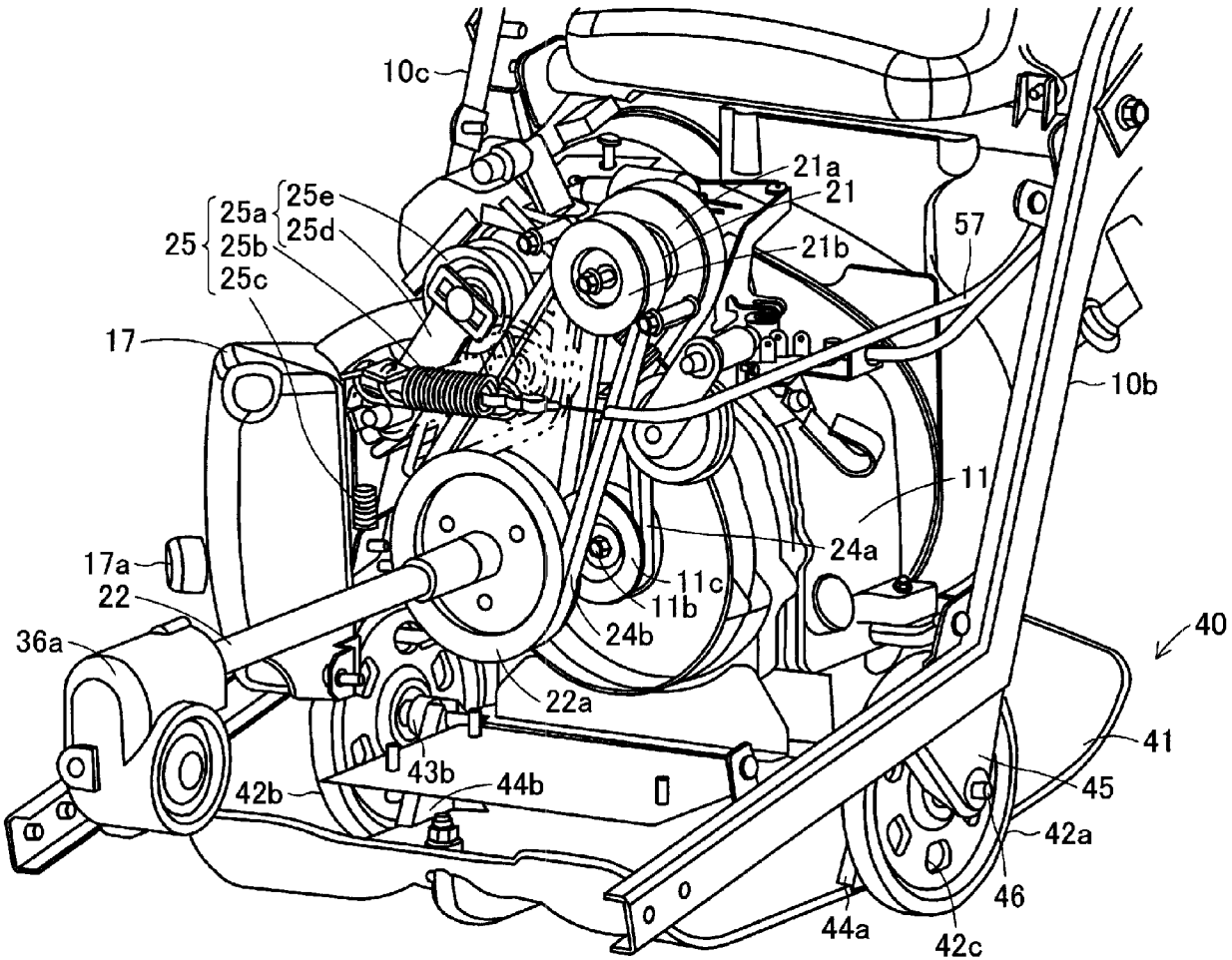
FIG. 8 is a perspective view showing a major portion of a main body of the snow blower according to a preferred embodiment of the present invention.

Further, as shown FIG. 8, a drive pulley 11*c* is fixed on the outer circumference of an output shaft 11*b* defining an end portion of the crankshaft 11*a*. An intermediate shaft 21 having a short length in the axial direction extending frontward from a portion corresponding to the output shaft 11*b* is arranged slightly rightward and above the output shaft 11*b*, and a long impeller drive shaft 22 having a length in the axial direction extending frontward from a portion corresponding to a front end of the intermediate shaft 21 longer than the intermediate shaft 21 is arranged slightly leftward and below the intermediate shaft 21. Both ends of the intermediate shaft 21 are rotatably supported in wall portions at the front and rear of an upper side portion of a bracket 23 (see FIGS. 5 and 7), and a driven pulley 21*a* having a diameter larger than that of the drive pulley 11*c* is fixed on a rear end outer circumference of the intermediate shaft 21.

An impeller drive pulley 21*b* having a diameter smaller than that of the driven pulley 21*a* is fixed on a front end outer circumference of the intermediate shaft 21. Further, an impeller driven pulley 22*a* having a diameter larger than that of the impeller drive pulley 21*b* is fixed on a rear end outer circumference of the impeller drive shaft 22. A first transmission belt 24*a* is meshed with the drive pulley 11*c* and the driven pulley 21*a*, and a second transmission belt 24*b* is meshed with the impeller drive pulley 21*b* and the impeller driven pulley 22*a*. As a result, a rotational force of the output shaft 11*b* is decelerated and transmitted to the impeller drive shaft 22. The positional relationship among the output shaft 11*b*, the intermediate shaft 21, and the impeller drive shaft 22 is in a state shown in FIG. 10 when seen from the front direction.

Figure 10:
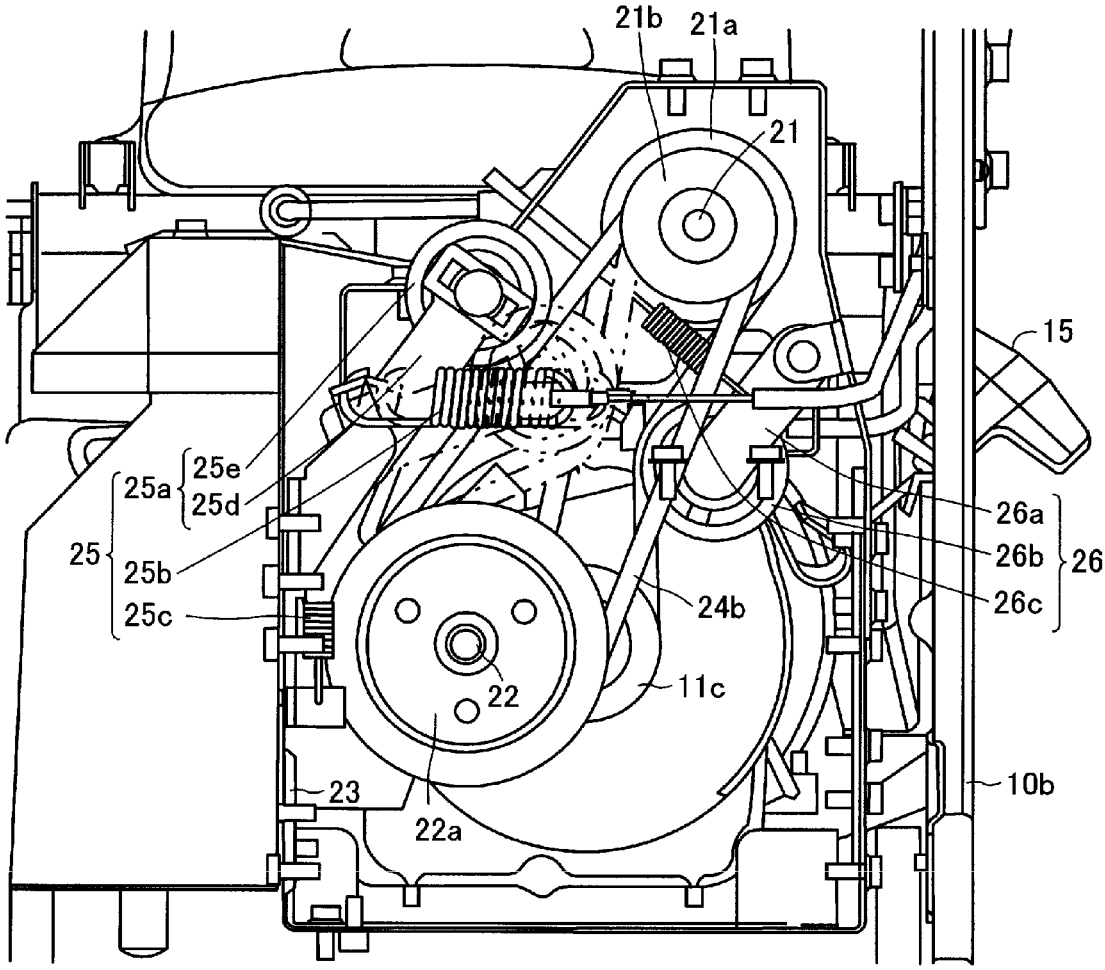
FIG. 10 is a front view showing a major portion in the main body of the snow blower according to a preferred embodiment of the present invention.

As shown in FIG. 10, the output shaft 11*b* and the impeller drive shaft 22 generally have the same height, and the impeller drive shaft 22 is arranged close to but slightly leftward in relation to the output shaft 11*b*. The intermediate shaft 21 is located slightly rightward and above the output shaft 11*b*. A belt clutch mechanism 25 is provided in an upper side portion on an outer circumference of the second transmission belt 24*b* or, in other words, in a portion located on an upper side of a slope of a virtual straight line of the case where both shaft axes of the intermediate shaft 21 and the impeller drive shaft 22 are connected by the virtual straight line. Further, a belt tensioner 26 is provided in a lower side portion on an outer circumference of the first transmission belt 24*a* or, in other words, in a portion located on a lower side of a slope of a virtual straight line of the case where both shaft axes of the output shaft 11*b* and the intermediate shaft 21 are connected by the virtual straight line.

The belt clutch mechanism 25 includes a belt clutch tensioner 25*a* rotatably mounted in a left wall portion in a lower side portion of the bracket 23, a clutch spring 25*b* pressing the belt clutch tensioner 25*a* against the second transmission belt 24*b* by an operation of the operating lever 52, and a return spring 25*c* biasing the belt clutch tensioner 25*a* to distance the belt clutch tensioner 25*a* from the second transmission belt 24*b*. The belt clutch tensioner 25*a* preferably includes a support member 25*d* with one end rotatably supported by the bracket 23 and a pulley 25*e* rotatably mounted to the other end of the support member 25*d*.

The pulley 25*e* is pressed against the second transmission belt 24*b*. Consequently, the second transmission belt 24*b* is tensioned, and the rotational force of the intermediate shaft 21 is transmitted to the impeller drive shaft 22. Then, pressure on the second transmission belt 24*b* by the pulley 25*e* is released. Consequently, the second transmission belt 24*b* slackens, and transmission of the rotational force from the intermediate shaft 21 to the impeller drive shaft 22 is interrupted. As the operating lever 52 is operated, the clutch spring 25*b* resists the elastic force of the return spring 25*c* and presses the pulley 25*e* of the belt clutch tensioner 25*a* against the second transmission belt 24*b*. When the operation of the operating lever 52 is cancelled, the elastic force of the return spring 25*c* releases the pressure on the second transmission belt 24*b* by the belt clutch tensioner 25*a*, and the pulley 25*e* moves away from the second transmission belt 24*b*.

The belt tensioner 26 includes a support member 26*a* with one end rotatably supported by the bracket 23, a pulley 26*b* rotatably mounted to the other end of the support member 26*a*, and a tension spring 26*c* pressing the pulley 26*b* against the first transmission belt 24*a* via the support member 26*a*. As a result of the pressure from the belt tensioner 26, tensile stress always having a constant strength is generated in the first transmission belt 24*a*, and the rotational force of the output shaft 11*b* is transmitted in an excellent state to the intermediate shaft 21.

Further, a rotational direction of the output shaft 11*b* is in the counterclockwise direction in a state seen from the front side. As a result, a left side portion of the first transmission belt 24*a* is pulled, and a right side portion thereof is sent out. Then, tensile stress of the left portion side of the first transmission belt 24*a* becomes larger than that of the right side portion thereof. Further, a right side portion of the second transmission belt 24*b* is pulled, and a left side portion thereof is sent out. Then, the tensile stress of the right portion side of the second transmission belt 24*b* becomes larger than that of the left side portion thereof. This means that the belt tensioner 26 is arranged on a side on which the tensile stress of the first transmission belt 24*a* is smaller, and that the belt clutch mechanism 25 is arranged on a side on which the tensile stress of the second transmission belt 24*b* is smaller. As a result, when rotating, the first transmission belt 24*a* and the second transmission belt 24*b* are appropriately tensioned, and the rotational force of the output shaft 11*b* is surely transmitted to the impeller drive shaft 22.

The snow blowing portion 30 includes an impeller 31 connected to the impeller drive shaft 22 (see FIG. 9), an auger 33 provided in an auger case 32, a chute 34, and so forth. The auger case 32 is generally provided as a cylindrical body with both of the left and right sides closed from which generally a half of the front portion of the circumferential surface is removed. A rear center portion of an outer circumference portion 32*a* is connected to a front end portion of the exterior casing portion 10*a* of the snow blower main body 10 via a connecting cover 32*b*. Further, a rotatable shaft is provided between the center portions of both side surface portions 32*c* and 32*d* of the auger case 32, and the auger 33 is mounted on the shaft 35.

Figure 3:
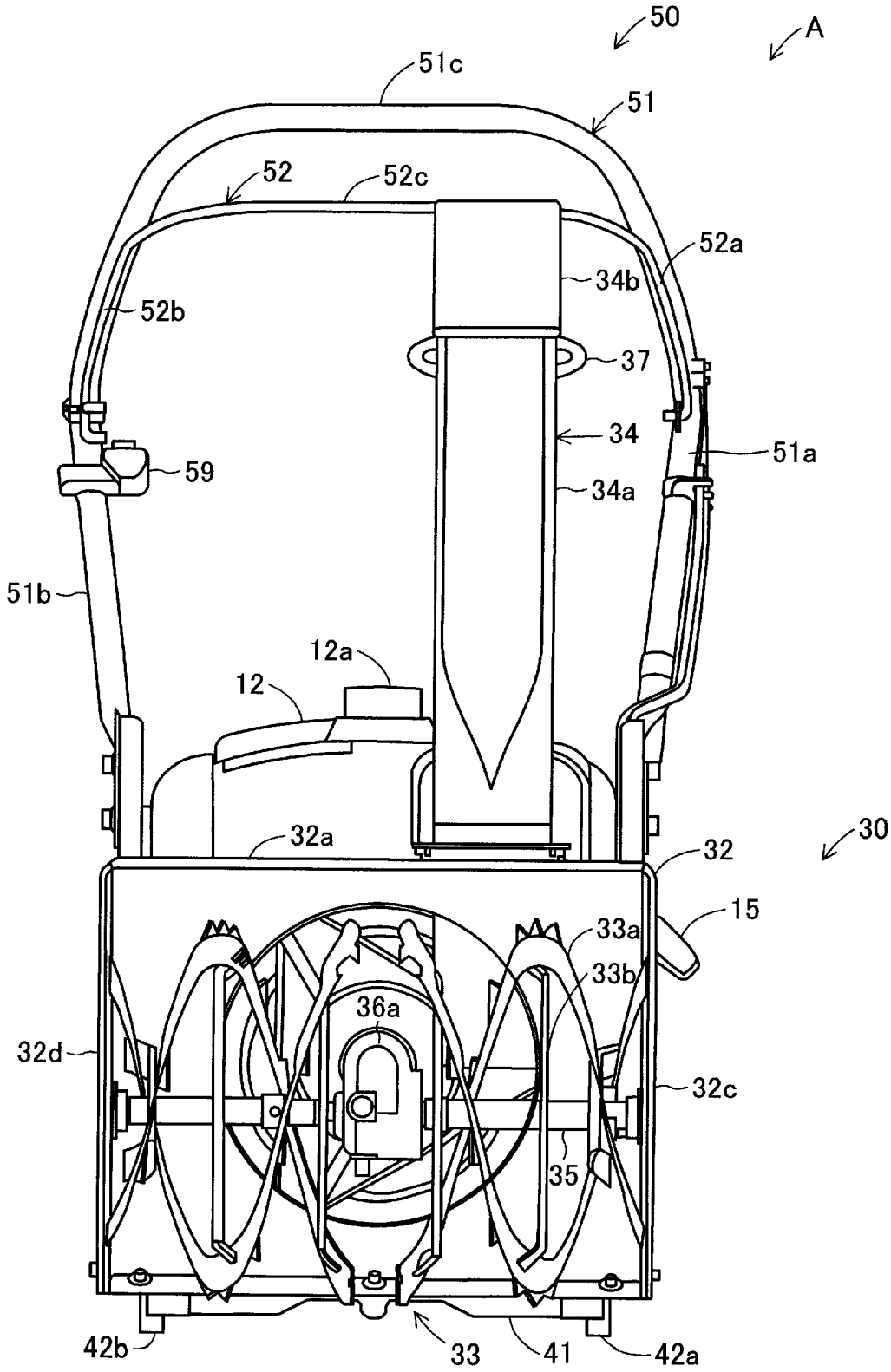
FIG. 3 is a front view showing the snow blower according to a preferred embodiment of the present invention.
Figure 4:
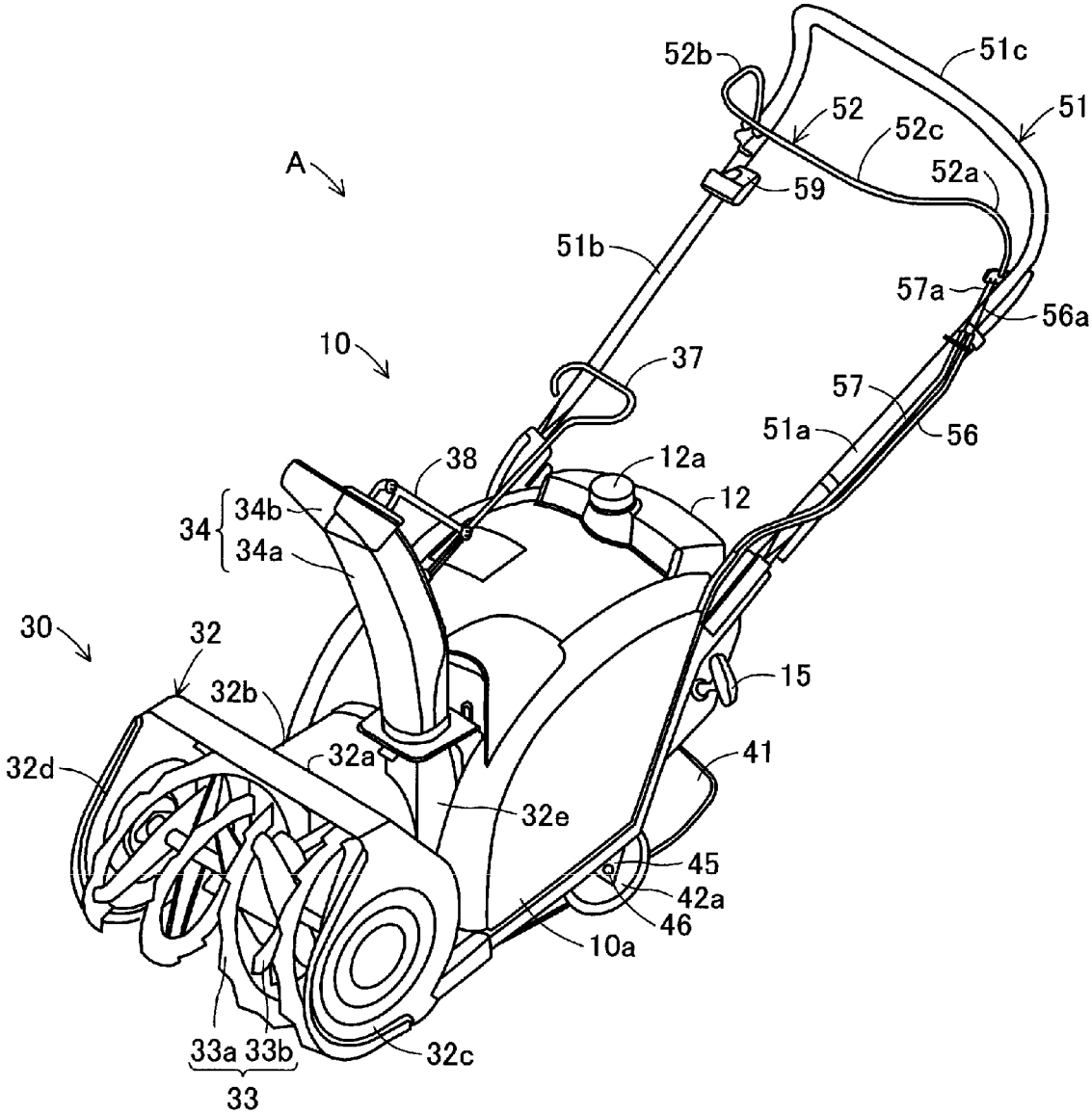
FIG. 4 is a perspective view showing the snow blower according to a preferred embodiment of the present invention.
Figure 5:
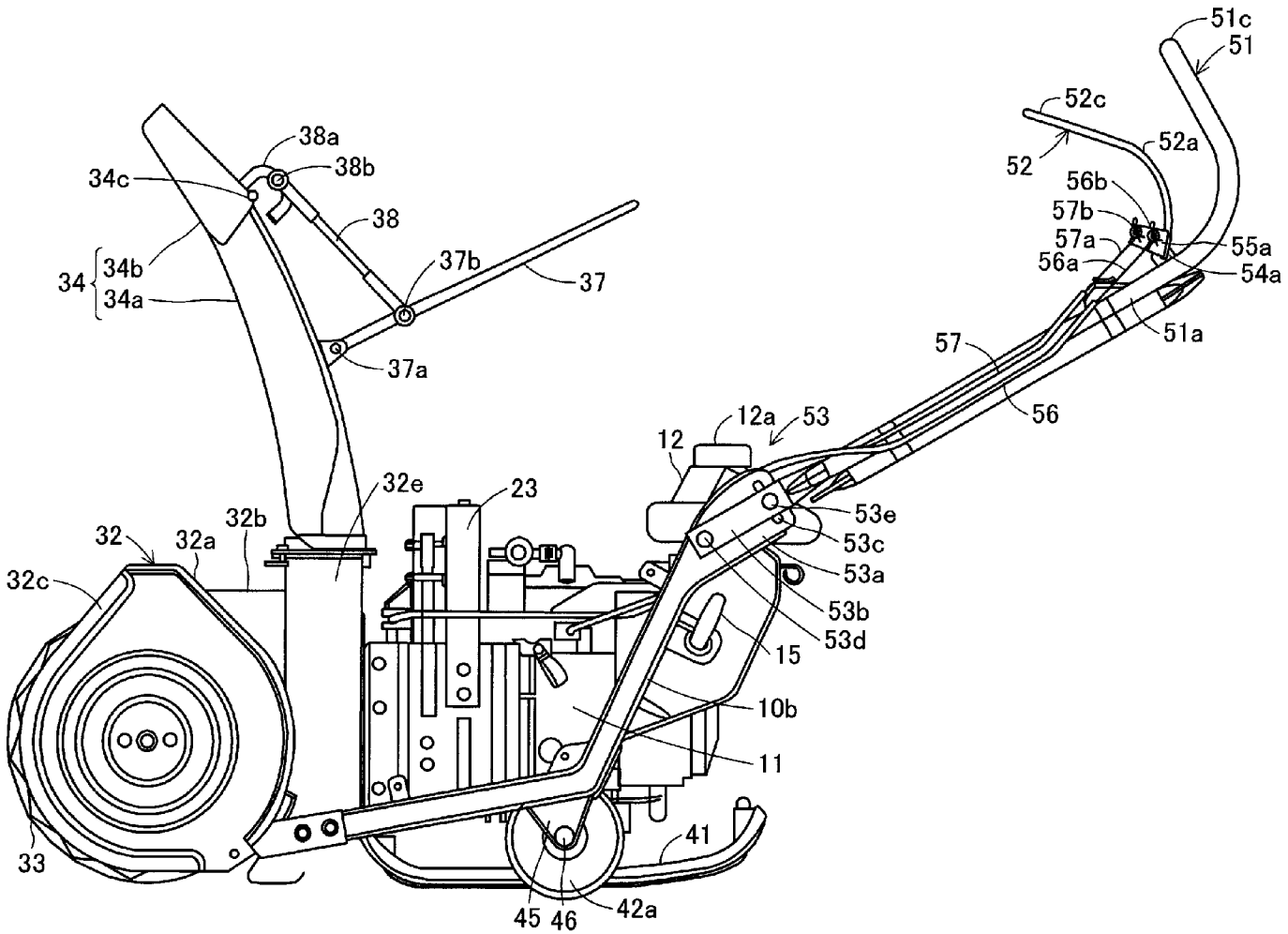
FIG. 5 is a side view showing the snow blower according to a preferred embodiment of the present invention in a state in which an exterior casing portion has been removed.

The auger 33 includes a plurality of rotary knives 33*a* in the shape of a spiral and a plurality of support plates 33*b* in the shape of a disk to support a rotary knife 33*a*. The auger 33 rotates as the shaft 35 rotates and, when the snow of a snow surface is caught in the auger 33, it rakes the snow to the inside of the auger case 32. Further, a front end portion of the impeller drive shaft 22 extends in the front direction of the impeller 31. The front end portion of the impeller drive shaft 22 is connected to a center portion of the shaft 35 via a worm gear 36*a* (a cover member for housing the worm gear is shown in FIG. 3 and FIG. 8). This means that the worm gear 36*a* changes the rotational force of the impeller drive shaft 22 extending in the front to rear direction into the direction of the shaft 35 extending in the width direction to transmit the rotational force thereto.

The impeller 31 includes a plurality of rotor blades rotating with the impeller drive shaft 22 at the center thereof and arranged in a rear center portion of the auger case 32. This means that a space is arranged on an inner side of the connecting cover 32*b* connecting the outer circumference portion 32*a* of the auger case 32 and the exterior casing portion 10*a* of the snow blower main body 10, and that the impeller 31 is arranged in this space. The upward extending chute 34 is provided on a right side portion of an upper surface of the auger case 32 where the impeller 31 is arranged. A chute main body 34*a* of the main body portion of the chute 34 includes a cylindrical body having a lower portion in the shape of a circular cylinder and an upper portion in the shape of a rectangular cylinder and extends upward while bending slightly obliquely frontward. A discharging opening portion 34*b* in the shape of a square is attached to an upper end of the chute main body 34*a*.

The chute main body 34*a* is connected to an upper portion of a base portion 32*e* projecting from the auger case 32 such that the chute main body 34*a* is rotatable in the direction around an axis thereof and detachable therefrom. The discharging opening portion 34*b* is connected to the chute main body 34*a* such that the discharging opening portion 34*b* is rotatable in the vertical direction around a supporting shaft 34*c* provided in the upper end on a side where a curve of the chute main body 34*a* projects. An elongated lever 37 rotatable in the vertical direction about a supporting shaft 37*a* is attached generally at the center in the vertical direction on the side where the curve of the chute main body 34*a* projects. An elongated connecting lever 38 rotatable about a supporting shaft 37*b* is connected to the lever 37 near the supporting shaft 37*a*.

A linking piece 38*a* in the shape of an inverted letter U is provided toward the outside in a vicinity of the supporting shaft 34*c* on an upper surface of the discharging opening portion 34*b*, and an upper end portion of the connecting lever 38 is rotatably connected to an upper portion of the linking piece 38*a* via a supporting shaft 38*b*. As a result, as the lever 37 is rotated to the left or to the right, the direction of the opening of the discharging opening portion 34*b* can be changed to the left or to the right. Further, as the lever 37 is vertically moved, the direction of the opening of the discharging opening portion 34*b* can be changed in the vertical direction to predefined angles.

The supporting portion 40 includes a sled 41 and a pair of transport wheels 42*a* and 42*b*. The sled 41 includes a board generally in the shape of a rectangle in a plan view and curving in the shape of a bow in a side view. As shown in FIG. 8, a mounting piece 44*a* provided with a swing shaft in the shape of a pipe (not shown) and a mounting piece 44*b* provided with a swing shaft 43*b* in the shape of a pipe are fixed respectively on both sides in the center portion in the front to rear direction on the upper surface of the sled 41. The mounting pieces 44*a* and 44*b* include a board generally in the shape of a triangle and are provided on the upper side of the sled 41 such that the mounting pieces 44*a* and 44*b* extend vertically. A swing shaft with an axial direction extending in the width direction is fixed on and passes through the upper end of the mounting piece 44*a*, and a swing shaft 43*b* with an axial direction extending in the width direction is fixed on and passes through the upper end of the mounting piece 44*b*.

Supporting pieces 45 (only one supporting piece is shown) provided with a supporting hole, respectively, extend downward from a front portion side (lower portion side) of the bending center portion of the supporting frames 10*b* and 10*c* of the snow blower main body 10, and a supporting shaft 46 is provided between the supporting holes of the supporting pieces 45. The supporting shaft 46 passes through an inner portion of the swing shaft 43*b* and so forth to support the sled 41 on the supporting frames 10*b* and 10*c* in a swingable state. Further, the transport wheels 42*a* and 42*b* are provided with a wheel main body in the shape of a disk and a bearing portion having a bearing hole arranged at the center, respectively, and arranged on both sides of the sled 41 such that the supporting shaft 46 passes through the bearing holes.

The operating portion 50 includes a handlebar 51 connected to both upper ends of the supporting frames 10*b* and 10*c*, the operating lever 52, various synchronized mechanisms described below, and so forth. The handlebar 51 is defined by a pipe provided generally in the shape of a square bracket in a plan view and in the shape of the letter L in a side view. A front side portion of the handlebar 51 includes side portions 51*a* and 51*b* extending in parallel or substantially in parallel toward an obliquely rear upper direction from both upper ends of the supporting frames 10*b* and 10*c*. A rear side portion of the handlebar 51 is provided with a gripping portion 51*c* generally in the shape of a square bracket that curves and extends upward from a rear end portion of the side portions 51*a* and 51*b*. The handlebar 51 is connected to the supporting frames 10*b* and 10*c* via a pair of connecting mechanisms 53 (only one connecting mechanism is shown) such that a position in a rotational direction can be changed.

The connecting mechanism 53 connects a supporting flat portion 53*a* with a wide side surface provided on the upper ends of the supporting frames 10*b* and 10*c* and a supported flat portion 53*b* with a wide side surface formed by pressing the front end portions of the side portions 51*a* and 51*b*. A shaft hole is arranged on the supporting flat portion 53*a* in a boundary portion opposing a portion having a narrow side surface on the supporting frames 10*b* and 10*c*. A guiding hole 53*c* in the shape of an arc with a shaft hole at the center is provided in a rear side portion of the supporting flat portion 53*a*. Further, a shaft hole is provided at a front end portion and a rear end portion of the supported flat portion 53*b*, respectively.

A shaft member 53*d* passes through the shaft hole at the front end portion of the supported flat portion 53*b* and the shaft hole of the supporting flat portion 53*a* to connect the handlebar 51 to the supporting frames 10*b* and 10*c* in a vertically rotatable manner. Further, a fastening member 53*e* including of a bolt and a nut is attached to the shaft hole at the rear end portion of the supported flat portion 53*b* and the guiding hole 53*c* of the supporting flat portion 53*a*. As a result, when the fastening member 53*e* is loosened, the handlebar 51 can be rotated upward or downward with the shaft member 53*d* at the center. When the fastening member 53*e* is fastened, the handlebar 51 can be fixed at a position thereof. Further, it may be also possible that the shaft member 53*d* is fastened.

Figure 11:
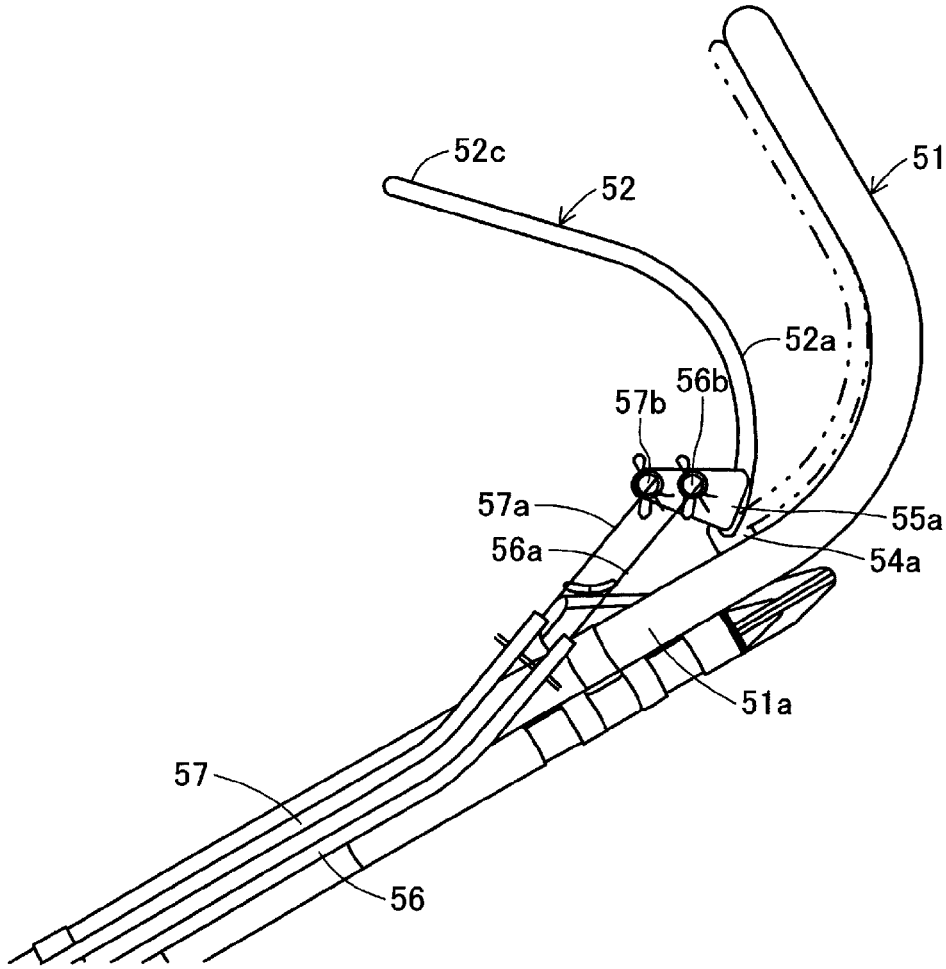
FIG. 11 is a right side view showing a state in which a throttle wire and a clutch wire according to a preferred embodiment of the present invention are connected to an operating lever.

The operating lever 52 includes an elongated body thinner than the handlebar 51, generally in the same shape as a rear side portion of the handlebar 51, and formed to be slightly smaller than the rear side portion of the handlebar 51. The operating lever 52 includes side portions 52*a* and 52*b* located at both sides and a gripping portion 52*c* located in a rear portion. Both ends of the side portions 52*a* and 52*b* bend toward the inside to provide the shape of the letter L of a small size, respectively. The operating lever 52 is attached to the handlebar 51 via a pair of the supporting pieces 54*a* (see FIG. 11) and 54*b* (see FIG. 12) such that the operating lever 52 overlaps with a rear side portion of the handlebar 51 by a pushing operation in the rear direction.

The supporting piece 54*a* includes a board-like member fixed in a standing state on a rear side portion of the side portion 51*a* and has a supporting hole arranged to pass in the width direction in the center portion. Similarly, the supporting piece 54*b* includes a board-like member fixed in a standing state on a rear side portion of the side portion 51*b* and has a supporting hole arranged to pass in the width direction in the center portion. The bending portion at an end of the side portion 52*a* passes through the supporting hole of the supporting piece 54*a* and the bending portion at an end of the side portion 52*b* passes through the supporting hole of the supporting piece 54*b* to attach the operating lever 52 in a rotatable manner relative to the handlebar 51 within the range from a position drawn with solid lines to a position drawn with chain double-dashed lines shown in FIG. 11 and FIG. 12.

A fixing piece 55*a* is fixed in a standing state on an upper surface of a rear side portion of a bending portion at the side portion 52*a* of the operating lever 52. The fixing piece 55*a* includes a board member generally in the shape of a wide triangle on which a latching pin 56*b* for latching an end of a wire portion 56*a* of a throttle wire 56 and a latching pin 57*b* for latching an end of a wire portion 57*a* of a clutch wire 57 are orthogonally fixed on a side. End portions of the wire portions 56*a* and 57*a* are connected, respectively, to an outer circumference of a ring-like member having a latching hole. The latching pin 56*b* located on a rear portion side (a rear portion side in a state drawn with solid lines in FIG. 11) of the fixing piece 55*a* passes through the latching hole of the ring-like member connected to an end portion of the wire portion 56*a* to latch the end portion of the wire portion 56*a* on the fixing piece 55*a*.

The other latching pin 57*b* passes through the latching hole of the ring-like member connected to an end portion of the wire portion 57*a* to latch the end portion of the wire portion 57*a* on the fixing piece 55*a*. A passing hole extending in a diametral or substantially diametral direction is provided in a vicinity of an end of the latching pins 56*b* and 57*b* respectively. A pin arranged to prevent dislocation is inserted through the both passing holes respectively. As a result, the ring-like members are prevented from being dislocated from the latching pins 56*b* and 57*b*. The end portion of the wire portion 56*a* is connected to the rear end connecting portion 18*a* of the speed governor 18, and the end portion of the wire portion 57*a* is connected to the clutch spring 25*b* of the belt clutch mechanism 25. As a result, the operating lever 52 is biased in a direction away from the handlebar 51 by an elastic force of the return spring 18*d* of the speed governor 18 and the return spring 25*c* of the belt clutch mechanism 25 and is therefore spaced away from the handlebar 51.

When the gripping portion 52*c* of the operating lever 52 is pressed against the side of the gripping portion 51*c* of the handlebar 51, the gripping portion 52*c* of the operating lever 52 moves to the side of the gripping portion 51*c*. Then, the wire portion 56*a* of the throttle wire 56 and the wire portion 57*a* of the clutch wire 57 are pulled in a rear direction, respectively. As the wire portion 56*a* of the throttle wire 56 is pulled in the rear direction, the rotational speed of the engine 11 increases. Further, as the wire portion 57*a* of the clutch wire 57 is pulled in the rear direction, the pulley 25*e* of the belt clutch mechanism 25 moves from a position shown by solid lines to a position shown by chain double-dashed lines in FIG. 8 and is pressed against the second transmission belt 24*b*. This results in a state in which the rotational force of the intermediate shaft 21 can be transmitted to the impeller drive shaft 22.

Figure 12:
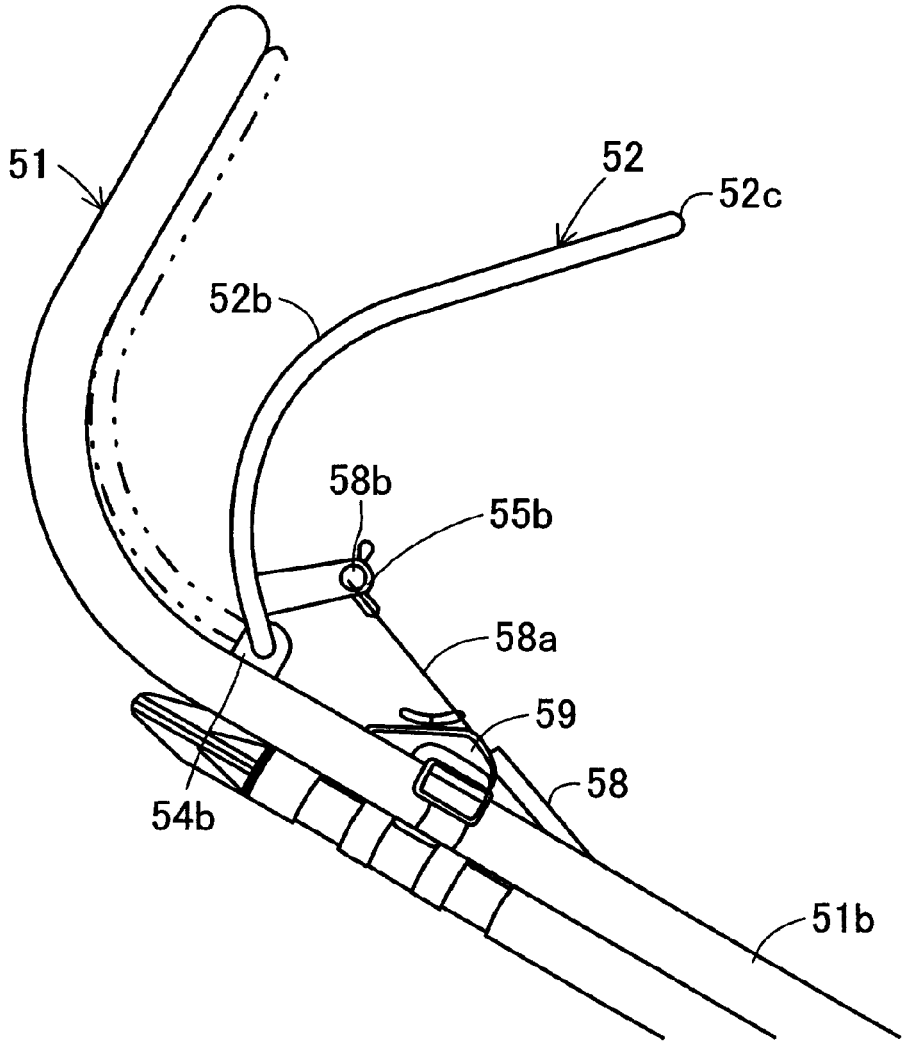
FIG. 12 is a left side view showing a state in which a wheel brake wire according to a preferred embodiment of the present invention is connected to the operating lever.

As shown in FIG. 12, a fixing piece 55*b* having a board-like shape is fixed in a standing state on an upper surface of a rear side portion of the bending portion at the side portion 52*b* of the operating lever 52. The fixing piece 55*b* includes a long, thin board member with a side surface on which a latching pin 58*b* for latching an end of a wire portion 58*a* of a wheel brake wire 58 is orthogonally fixed. Further, an end portion of the wire portion 58*a* is connected to an outer circumference of a ring-like member having a latching hole. The latching pin 58*b* of the fixing piece 55*b* passes through the latching hole of the ring-like member connected to the end portion of the wire portion 58*a* to latch the end portion of the wire portion 58*a* on the fixing piece 55*b*.

Though not shown in the drawings, a latching piece capable of moving closer to or farther away in relation to the inside of a plurality of passing openings 42*c* in the wheel main body is provided in a vicinity of the transport wheel 42*a*, and the end portion of the wire portion 58*a* is connected to a lock mechanism arranged to make the latching piece move closer to or farther away therefrom. Further, the lock mechanism also includes a biasing mechanism biasing the latching piece to the side of the transport wheel 42*a*. As a result, the latching piece passes through the passing opening 42*c* of the transport wheel 42*a* such that the operating lever 52 is not operated, and the transport wheel 42*a* is in a non-rotating state.

When the gripping portion 52*c* of the operating lever 52 is pressed against the side of the gripping portion 51*c* of the handlebar 51, the wire portion 58*a* of the wheel brake wire 58 is pulled in the rear direction. Consequently, the latching piece moves farther from the transport wheel 42*a*, and the transport wheel 42*a* is in a rotatable state. An engine switch 59 is provided on a front portion side of the supporting piece 54*b* on an upper surface of the side portion 52*b* of the operating lever 52. The engine switch 59 stops the operation of the engine 11 if turned on while the engine 11 is operating.

In order to operate the snow blower A, firstly, after the gripping portion 51*c* of the handlebar 51 is held, the gripping portion 52*c* of the operating lever 52 is pressed against the side of the gripping portion 51*c* of the handlebar 51 to place the transport wheel 42*a* in the rotatable state. Then, the handlebar 51 is simultaneously pushed and operated to the left or the right, and the transport wheels 42*a* and 42*b* are made to rotate on a road surface to move the snow blower A to the snow covered surface. The recoil handle 15 is pulled, and the engine 11 is started. At the same time as this, after the discharging opening portion 34*b* of the chute 34 is directed in a predefined direction, for example, in a side direction of the snow blower A, the gripping portion 52*c* of the operating lever 52 is pressed against the side of the gripping portion 51*c* of the handlebar 51 again.

As a result, the transport wheel 42*a* is in the rotatable state again. As the accelerator lever 18*c* of the speed governor 18 rotates to increase the opening angle of the throttle valve of the carburetor 14, the rotational speed of the engine 11 gradually increases. At the same time as this, the rotational force of the output shaft 11*b* is transmitted from the drive pulley 11*c* to the driven pulley 21*a* via the first transmission belt 24*a* tensioned by the pressure of the belt tensioner 26, and the intermediate shaft 21 rotates.

The belt clutch tensioner 25*a* of the belt clutch mechanism 25 is biased on the side of the second transmission belt 24*b*, and the belt clutch tensioner 25*a* and the second transmission belt 24*b* become in the state shown by chain double-dashed lines from the state shown by solid lines in FIG. 8. As a result, the pulley 25*e* is pressed against the second transmission belt 24*b*. Then, the rotational force of the intermediate shaft 21 is transmitted from the impeller drive pulley 21*b* to the impeller driven pulley 22*a* via the second transmission belt 24*b* tensioned by the pressure of the belt clutch mechanism 25, and the impeller drive shaft 22 rotates. As the impeller drive shaft 22 rotates, the impeller 31 and the auger 33 start rotating, respectively. The snow on the snow covered surface is raked into the auger case 32 by the rotation of the auger 33.

After being blown up into an upper side of the chute 34 by the rotation of the impeller 31, the snow, having been raked into the auger case 32, is discharged in a side direction of the snow blower A from the opening of the discharging opening portion 34*b*. The snow blower A is moved on the snow covered surface to sequentially remove the snow. In this case, as the sled 41 is in contact with the snow covered surface and slides on the snow covered surface, the snow blower A can be easily moved. Since the center of gravity of the snow blower A is in a low position, the snow blower A can be moved in a stable state.

The pushing operation of the operating lever 52 is canceled by removing a hand from the operating lever 52 to stop removing the snow. As a result, the rotational speed of the engine 11 is decreased, and the pressure on the second transmission belt 24*b* by the pulley 25*e* of the belt clutch mechanism 25 is released to interrupt transmission of the drive force from the engine 11 to the auger 33. Further, the latching piece of the lock mechanism passes through the passing opening 42*c* of the transport wheel 42*a* to place the transport wheel 42*a* in the non-rotating state. The engine switch 59 is turned on to stop the operation of the engine 11.

As described above, the drive force of the engine 11 is transmitted to the output shaft 11*b* integral with the crankshaft 11*a* to rotate the output shaft 11*b* in the snow blower A according to a preferred embodiment. Then, the rotational force of the output shaft 11*b* is transmitted to the intermediate shaft 21 via the first transmission belt 24*a* meshed between the drive pulley 11*c* of the output shaft 11*b* and the driven pulley 21*a* of the intermediate shaft 21. The rotational force is transmitted from the intermediate shaft 21 to the impeller drive shaft 22 via the second transmission belt 24*b* meshed between the impeller drive pulley 21*b* of the intermediate shaft 21 and the impeller driven pulley 22*a* of the impeller drive shaft 22.

As described above, the rotational force of the output shaft 11*b* is transmitted to the impeller drive shaft 22 via the intermediate shaft 21 arranged in a position higher than the output shaft 11*b* and the impeller drive shaft 22. Therefore, the output shaft 11*b* and the impeller drive shaft 22 can have generally the same height in a lower position of the snow blower main body 10. As a result, an engine 11 having a large weight and volume can be arranged in a lower portion of the snow blower main body 10. As a result, it is possible to provide a low center of gravity for the snow blower A. Further, as the engine 11 is arranged in the lower portion of the snow blower main body 10, a space in the upper portion of the snow blower main body 10 is not occupied by the engine 11. Therefore, the whole snow blower main body 10 can be correspondingly lowered and/or downsized. Further, the exterior casing portion 10*a* and the bracket 23 can be also downsized.

The first transmission belt 24*a* is inclined and meshed with the drive pulley 11*c* and the driven pulley 21*a*, and the second transmission belt 24*b* is inclined in the same direction with the first transmission belt 24*a* and meshed with the impeller drive pulley 21*b* and the impeller driven pulley 22*a*. Therefore, the height of the snow blower main body 10 can be lowered due to the inclination of the transmission belts. The output shaft 11*b* and the impeller drive shaft 22 are arranged in a position such that the shaft axes of both shafts are in a vicinity of each other in a view seen from the front direction. In addition, the belt tensioner 26 tensioning the first transmission belt 24*a* is arranged on the lower portion side of the first transmission belt 24*a*, and the belt clutch mechanism 25 is arranged on the upper portion side of the second transmission belt 24*b*.

As a result, the belt tensioner 26 and the belt clutch mechanism 25 can be compactly arranged in all directions such as the front to rear direction, the width direction, and the vertical direction of the snow blower main body 10 such that the belt tensioner 26 and the belt clutch mechanism 25 do not interfere with each other. In this case, the belt tensioner 26 is arranged on the outer circumference of a portion where the tensile stress between shafts generated in the first transmission belt 24*a* is small, and the belt clutch mechanism 25 is arranged on the outer circumference of a portion where the tensile stress between shafts generated in the second transmission belt 24*b* is small. As a result, it is possible to appropriately tension the first transmission belt 24*a* and the second transmission belt 24*b* to surely transmit the rotational force. The snow blower is not limited to the preferred embodiments described above but can be implemented within the technical scope of the present invention with appropriate modifications.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A snow blower comprising:

an engine including a crankshaft arranged along a front to rear direction of the snow blower;

an output shaft provided on a front end portion of the crankshaft, arranged substantially coaxially with the crankshaft, and including an outer circumferential portion to which a drive pulley is attached;

an intermediate shaft arranged to extend along the front to rear direction and above the output shaft, the intermediate shaft including a rear end outer circumferential portion on which a driven pulley is fixed and a front end outer circumferential portion on which an impeller drive pulley is attached;

an impeller drive shaft arranged to extend in the front to rear direction and below the intermediate shaft, the impeller drive shaft including a rear end outer circumferential portion on which an impeller driven pulley is attached;

a first transmission belt meshed with the drive pulley and the driven pulley;

a second transmission belt meshed with the impeller drive pulley and the impeller driven pulley; and an impeller connected to, and arranged to be rotated by, the impeller drive shaft; wherein the output shaft and the impeller drive shaft are arranged at substantially the same height in a vertical direction of the snow blower.

2. The snow blower according to claim 1, wherein the output shaft and the impeller drive shaft are arranged such that shaft axes of the output shaft and the impeller drive shaft are either substantially coaxial, or in a vicinity of each other in a view seen from a front of the snow blower.

3. The snow blower according to claim 1, wherein the first transmission belt and the second transmission belt are both inclined in the same direction with respect to the vertical direction of the snow blower.

4. A snow blower comprising:

an engine including a crankshaft arranged along a front to rear direction of the snow blower;

an output shaft provided on a front end portion of the crankshaft, arranged substantially coaxially with the crankshaft, and including an outer circumferential portion to which a drive pulley is attached;

an intermediate shaft arranged to extend along the front to rear direction and above the output shaft, the intermediate shaft including a rear end outer circumferential portion on which a driven pulley is fixed and a front end outer circumferential portion on which an impeller drive pulley is attached;

an impeller drive shaft arranged to extend in the front to rear direction and below the intermediate shaft, the impeller drive shaft including a rear end outer circumferential portion on which an impeller driven pulley is attached;

a first transmission belt meshed with the drive pulley and the driven pulley;

a second transmission belt meshed with the impeller drive pulley and the impeller driven pulley; and an impeller connected to, and arranged to be rotated by, the impeller drive shaft; wherein the intermediate shaft and the impeller drive shaft are arranged such that a virtual straight line connecting shaft axes of the intermediate shaft and the impeller drive shaft is inclined to one side of a width direction of the snow blower when viewed from a front of the snow blower; and a belt clutch mechanism, arranged to enable or interrupt transmission of a rotational force of the intermediate shaft to the impeller drive shaft by changing a tensile stress of the second transmission belt, is arranged on an outer circumferential side of the second transmission belt between the impeller drive pulley and the impeller driven pulley.

5. The snow blower according to claim 4, wherein the outer circumferential side of the second transmission belt is a portion located on an upper side of the virtual straight line connecting the shaft axes of the intermediate shaft and the impeller drive shaft.

6. The snow blower according to claim 4, wherein the output shaft and the impeller drive shaft are arranged such that the shaft axes of the output shaft and the impeller drive shaft are either substantially coaxial, or in a vicinity of each other in a view seen from a front of the snow blower; and a belt tensioner, arranged to increase a tensile stress of the first transmission belt, is arranged on an outer circumferential side of the first transmission belt at a side opposite where the belt clutch mechanism is arranged on the second transmission belt.

7. The snow blower according to claim 6, wherein the belt tensioner is arranged at a side of the outer circumference of the first transmission belt where a smaller tensile stress is generated when the first transmission belt is rotating; and the belt clutch mechanism is arranged at a side of the outer circumference of the second transmission belt where a smaller tensile stress is generated when the second transmission belt is rotating.

8. The snow blower according to claim 4, wherein the first transmission belt and the second transmission belt are both inclined in the same direction with respect to a vertical direction of the snow blower.

* * * * *